US008177615B2

(12) United States Patent
Jackson

(10) Patent No.: US 8,177,615 B2
(45) Date of Patent: May 15, 2012

(54) BLACKJACK GAME FOR ELECTRONIC GAMING DEVICES

(75) Inventor: Kathleen Nylund Jackson, Scituate, MA (US)

(73) Assignee: Precedent Gaming, Inc., Scituate, MA (US)

( * ) Notice: Subject to any disclaimer, the term of this patent is extended or adjusted under 35 U.S.C. 154(b) by 319 days.

(21) Appl. No.: 12/455,863

(22) Filed: Jun. 8, 2009

(65) Prior Publication Data

US 2009/0305761 A1 Dec. 10, 2009

(51) Int. Cl.
*A63F 9/24* (2006.01)

(52) U.S. Cl. ..... 463/12; 463/13; 273/274; 273/292

(58) Field of Classification Search ..... 463/12, 463/13; 273/274, 292
See application file for complete search history.

(56) References Cited

U.S. PATENT DOCUMENTS

| | | | | |
|---|---|---|---|---|
| 5,174,579 | A | 12/1992 | Griffiths | |
| 5,280,915 | A | 1/1994 | Groussman | |
| 5,288,077 | A | 2/1994 | Jones | |
| 5,322,295 | A | 6/1994 | Cabot et al. | |
| 5,407,209 | A | 4/1995 | Prerost | |
| 5,411,268 | A | 5/1995 | Nelson et al. | |
| 5,577,731 | A | 11/1996 | Jones | |
| 5,615,888 | A | 4/1997 | Lofink et al. | |
| 5,632,485 | A | 5/1997 | Woodland et al. | |
| 5,636,842 | A | 6/1997 | Cabot et al. | |
| 5,673,917 | A | 10/1997 | Vancura | |
| 5,732,949 | A | 3/1998 | Josephs | |
| 5,791,989 | A | 8/1998 | Slinkman | |
| 5,839,730 | A | 11/1998 | Pike | |
| 5,979,897 | A | 11/1999 | Grossman | |
| 6,322,075 | B1 * | 11/2001 | DeFranco | 273/274 |
| 6,345,824 | B1 | 2/2002 | Selitzky | |
| 6,406,023 | B1 | 6/2002 | Rowe | |
| 6,450,500 | B1 | 9/2002 | Miller | |
| 6,481,717 | B1 | 11/2002 | Richardelle | |
| 6,481,718 | B2 | 11/2002 | Koelling | |
| 6,481,719 | B2 | 11/2002 | Webb | |
| 6,523,831 | B2 | 2/2003 | Webb | |
| 6,543,773 | B2 | 4/2003 | Mims | |
| 6,592,125 | B1 * | 7/2003 | Lizak | 273/292 |
| 6,726,427 | B2 | 4/2004 | Jarvis et al. | |
| 6,808,173 | B2 | 10/2004 | Snow | |
| 6,845,981 | B1 | 1/2005 | Ko | |
| 6,854,731 | B2 | 2/2005 | Saucier | |
| 6,863,274 | B2 | 3/2005 | Webb | |
| 6,902,167 | B2 | 6/2005 | Webb | |
| 7,036,821 | B2 | 5/2006 | Hall | |
| 7,066,465 | B2 | 6/2006 | Daines | |
| 7,066,466 | B1 | 6/2006 | Stavinsky et al. | |

(Continued)

*Primary Examiner* — Peter DungBa Vo
*Assistant Examiner* — Mukund G Patel

(57) ABSTRACT

A method of playing a wagering blackjack-type card game on an electronic device wherein the object of the game is to play and win or at least tie both of two player hands against a single dealer hand. Preferably four cards are dealt to each player who has placed a wager, and at least an initial up card for the dealer is displayed. Each player then has the option of forfeiting at least a portion of his wager, or continuing to play. If the player decides to continue playing, the initially-dealt cards are then randomly displayed as two cards in each of two separate player hands. Each player hand is then finalized according to traditional blackjack rules, including doubling, hitting and standing. Each finalized player hand is then compared with a finalized dealer hand, with the winning wagers being determined by a predetermined paytable. A side bet is also disclosed.

18 Claims, 11 Drawing Sheets

U.S. PATENT DOCUMENTS

| | | | | |
|---|---|---|---|---|
| 7,080,839 | B2 | 7/2006 | Shackleford | |
| 7,097,175 | B2 | 8/2006 | Centrone | |
| 7,108,264 | B2 | 9/2006 | Byme et al. | |
| 7,144,011 | B2 | 12/2006 | Asher et al. | |
| 7,144,012 | B2 * | 12/2006 | Grigsby | 273/292 |
| 7,147,226 | B2 | 12/2006 | Moshal | |
| 7,175,180 | B2 | 2/2007 | Webb | |
| 7,222,854 | B2 | 5/2007 | Sorge | |
| 7,222,855 | B2 | 5/2007 | Sorge | |
| 7,261,297 | B2 | 8/2007 | Bermudez | |
| 7,267,343 | B2 | 9/2007 | Schreiner | |
| 7,309,066 | B2 | 12/2007 | Donaldson | |
| 7,354,042 | B2 | 4/2008 | Moshal | |
| 2004/0259619 | A1 | 12/2004 | Cranford | |
| 2005/0090304 | A1 | 4/2005 | Crawford et al. | |
| 2005/0164759 | A1 | 7/2005 | Smith et al. | |
| 2005/0164762 | A1 | 7/2005 | Smith et al. | |
| 2006/0055114 | A1 | 3/2006 | White et al. | |
| 2006/0058083 | A1 | 3/2006 | Crawford et al. | |
| 2006/0058085 | A1 | 3/2006 | White et al. | |
| 2006/0058088 | A1 | 3/2006 | Crawford et al. | |
| 2006/0058090 | A1 | 3/2006 | Crawford et al. | |
| 2006/0058091 | A1 | 3/2006 | Crawford et al. | |
| 2006/0058092 | A1 | 3/2006 | Crawford et al. | |
| 2006/0058093 | A1 | 3/2006 | White et al. | |
| 2006/0068498 | A1 | 3/2006 | White et al. | |
| 2006/0068864 | A1 | 3/2006 | White et al. | |
| 2006/0068865 | A1 | 3/2006 | White et al. | |
| 2006/0068866 | A1 | 3/2006 | White et al. | |
| 2006/0068867 | A1 | 3/2006 | White et al. | |
| 2006/0068868 | A1 | 3/2006 | Crawford et al. | |
| 2006/0068869 | A1 | 3/2006 | Kuhn et al. | |
| 2006/0068870 | A1 | 3/2006 | Crawford et al. | |
| 2006/0068871 | A1 | 3/2006 | Crawford et al. | |
| 2006/0068879 | A1 | 3/2006 | Crawford et al. | |
| 2006/0068899 | A1 | 3/2006 | White et al. | |
| 2006/0131809 | A1 * | 6/2006 | Lancaster et al. | 273/292 |
| 2006/0199629 | A1 | 9/2006 | Sines et al. | |
| 2006/0205472 | A1 | 9/2006 | Kuhn et al. | |
| 2007/0015561 | A1 | 1/2007 | Sines et al. | |
| 2007/0049368 | A1 | 3/2007 | Kuhn et al. | |
| 2007/0072663 | A1 | 3/2007 | Kuhn et al. | |
| 2007/0072664 | A1 | 3/2007 | Kuhn et al. | |
| 2007/0142107 | A1 | 6/2007 | Kuhn et al. | |
| 2007/0176366 | A1 | 8/2007 | Jones | |
| 2007/0216098 | A1 * | 9/2007 | Santiago | 273/292 |
| 2007/0281786 | A1 | 12/2007 | Kuhn et al. | |
| 2008/0012224 | A1 | 1/2008 | Hall | |
| 2008/0018051 | A1 * | 1/2008 | Lutnick et al. | 273/293 |
| 2008/0076500 | A1 | 3/2008 | Lancaster et al. | |

* cited by examiner

| 2 – Hand Blackjack Payouts | |
|---|---|
| **Hand / Hand Result** | **Play Bet Pays** |
| BJ / BJ | 10 : 1 |
| BJ / Win | 4 : 1 |
| BJ / Tie | 3 : 1 |
| Win / Win | 2 : 1 |
| Win / Tie | 1 : 1 |
| Tie / Tie | Push |

*Fig. 10*

| Side Bet Payouts | | | | |
|---|---|---|---|---|
| | 2 – Hand | 3 – Hand | 4 – Hand | 5+ – Hand |
| **Straight Flush** (ENTIRE HAND) | 3 : 1 | 10 : 1 | 50 : 1 | 100 : 1 |
| **Flush** (ENTIRE HAND) | 1 : 1 | 5 : 1 | 15 : 1 | 25 : 1 |
| **Straight** (ENTIRE HAND) | 1 : 1 | 7 : 1 | 15 : 1 | 25 : 1 |
| (ANY) **4-of-a-Kind** | — — — | — — — | 100 : 1 | 50 : 1 |
| (ANY) **3-of-a-Kind** | — — — | 10 : 1 | 7 : 1 | 5 : 1 |
| (ANY) **Pair** | 2 : 1 | 1 : 1 | 1 : 1 | 1 : 1 |

*Fig. 11*

BLACKJACK GAME FOR ELECTRONIC GAMING DEVICES

BACKGROUND OF THE INVENTION

1. Field of the Invention

The present invention relates to a variant of blackjack suitable for use in casinos, gaming establishments, internet sites or mobile devices as an electronic table game or electronic machine game. The invention further relates to electronic gaming wherein the object of the game is to play two hands of blackjack against a dealer or house, with pays being based on winning both hands.

2. Background of the Art

Blackjack is one of the oldest and still most popular gambling games in casinos today. The success of blackjack games in the gaming industry is partially based on the game's simplicity (i.e., there is widespread public knowledge of the game rules) and the fact that players feel more directly involved in exercising judgment in the play of the game.

The commonly-known traditional blackjack game is played between at least one player and a dealer. The purpose of the game is to beat the dealer by assembling a hand of cards that is valued higher than the dealer's hand without going over 21 points. Aces are worth 1 or 11 points, Tens and Face Cards are worth 10 points, and all other cards are worth their face value (i.e., a 2 is worth 2 points, a 3 is worth 3 points, etc.). The game begins with each player making a wager to play one hand and receiving two cards, either both face up or face down. The dealer receives one card face up and the other face down. Any player receiving a natural twenty-one or Blackjack (i.e. a total of 21 in the initial dealt hand) is immediately rewarded, typically at a rate of 3:2 or 6:5, and play is terminated as to that player. Each remaining player examines his hand and forms a final player hand by taking a hit (i.e., receiving another card), or standing (i.e., refusing to receive any additional cards and making final the current hand). A player may hit as many times as the player wishes as long as the player does not bust (i.e., have a cumulative total greater than 21). When a player busts, the player's wager is immediately collected and play is terminated as to that player.

Additional options are available depending on the initial hand dealt. If the player receives a pair (i.e., two cards having the same face value), the player may split the pair and use each card as a basis for a separate hand. For example, if a player were to be dealt a pair of eights, the player may choose to split the pair and continue play with two hands each having an eight and an additional dealt card. Each of those individual hands is then played independently according to the same rules as above. A player may also have the option to double down, which allows the player to double his wager and receive exactly only one additional card. Surrender is an another option that allows the player to forfeit (typically) one-half of his wager and terminate play if the dealer's up card is an Ace or Ten-Value Card. These options, if used correctly according to basic strategy, are valuable tools for the player, and help the player to enhance his chances to win against the dealer.

After all the players have played their hands, the dealer reveals the face-down card in the dealer's hand. The dealer plays the dealer's hand according to established house rules. That is, the house uses established "house rules" to eliminate the dealer's discretion, so that the dealer hits or stands as the house rules dictate. The dealer then resolves the wagers. In resolving the wagers, players with a final hand total closer to 21 than the dealer's final hand total are rewarded at even money. However, if the dealer's final hand is closer to 21, the player loses his wager. If the dealer busts, all players who did not bust or receive a blackjack win. Most usually, if the player and dealer push (i.e., tie), the player's wager is returned.

Despite the popularity of blackjack, there are still problems with its gameplay, both for the player and the casino. Because it is so simple to play, players may become bored with the monotonous routine. In addition, the even money rewards makes it difficult to win large sums of money unless large sums are wagered. There is also an intimidation factor in blackjack: less skilled players are sometimes reluctant to play with seasoned players who may become agitated when they believe the amateur has made a decision that adversely affects the pro. As far as the drawbacks for the casino are concerned, blackjack requires skilled dealers who must thoroughly understand the gameplay and payouts. Their salaries and benefits cut into the casino's bottom line. Another major problem for the house is that blackjack is time intensive, allowing only about 40 hands per player per hour. The house has a built-in edge on virtually any gambling game, so the more number of hands played in a particular time period increases the revenue for the casino. And since the house's edge in blackjack is traditionally lower than 2%, the casino's profits are slim.

It is for these reasons that inventors and gaming manufacturers have strived to create new variations of blackjack games that are more thrilling for the player and more lucrative for the house. Unique gameplay with additional wager opportunities and higher risk/reward options (and most often higher house edges) can attract new types of players who are looking for more stimulating games with larger payouts. And this may keep them playing longer, thereby increasing revenue for the casino.

Prior art has taught numerous attempts to make blackjack more exciting, stimulating and lucrative. One particular way is allowing the player to play more than one hand at once. U.S. Pat. No. 5,280,915 (Groussman) allows the player to play two hands of blackjack at a single player station, requiring one wager per hand.

U.S. Pat. No. 6,726,427 (Jarvis, et al.) teaches multiple hands of blackjack that can be indiviually wagered upon, played in a rapid substantially automatic fashion and according to a preset strategy.

In U.S. Pat. No. 7,309,066 (Donaldson), the player is initially dealt three cards that create at least two separate and playable hands. One of those cards dealt to each player is considered a "shared card" in its relationship to each of the other two cards dealt to that player.

U.S. Pat. No. 7,036,821 (Hall) comprises a method in which each player places an initial bet on each of two or more hands of blackjack, each player then having an option to switch cards between the two or more hands. The two or more hands dealt to each player are then played out in a conventional blackjack manner, in order to settle the initial bets placed on each of the hands.

U.S. Pat. No. 5,322,295 (Cabot, et al.) describes methods of playing card games wherein a player makes a plurality of wagers and is provided with an initial partial card hand for each wager. The player then receives additional cards which the player assigns to the previously received initial partial hands.

U.S. Pat. No. 5,732,949 (Josephs) describes a modified version of the game of blackjack that includes a player playing first and second hands. The invention comprises the player receiving (a) a first supplemental payoff if the first and second hands both equal the hand of the dealers (b) a second supplemental payoff if the first and second hands are equal, or (c) a third supplemental payoff if either the first hand or the second hand equal the dealer's hand. In a preferred embodiment, the supplemental payoffs are offered at no additional cost to the player.

U.S. Pat. No. 5,411,268 No. (Nelson, et al.) teaches a game with two hands for the player and two hands for the dealer in which the gaming establishment is not an active player but rather patrons play against each other.

U.S. Pat. No. 6,406,023 (Rowe) discloses a method in which the player receives four cards in a rectangular array. The initial cards are arranged in a rectangular array with rows, columns and/or diagonals of the array defining the hands. Each hand can be played and/or evaluated using certain aspects of blackjack, poker or other traditional card game play or evaluation. At least some prizes or top winning outcomes for a round of play must include winning outcomes from at least two, and preferably from all, of the hands played by a given player.

U.S. Pat. No. 6,322,075 (DeFranco) describes a blackjack-type card game where each player receives a four playing card array arranged in a square, with two of the cards face-up and two face down. Wagers are made on at least one and at most three of the six possible different two-cards of the array, betting against the dealer's hand. A dealer's hand consists of two cards, one card face-up and one card face-down. The dealer's play is governed by traditional blackjack rules.

United States Patent Application No. 20080076500 (Lancaster, et al.) describes a gaming device having a primary game and a secondary game. The gaming device includes a primary game, such as blackjack or 21 operable on a wager by a player, and an optional secondary game that is operable on a secondary game wager by a player. After placing a secondary game wager and satisfying certain criteria in the primary game, one or more players are provided with a secondary game card to be used in the secondary game. The secondary game is resolved after a player has accumulated a plurality of secondary game cards over the course of several sequentially played rounds of the primary game.

United States Patent Application No. 20080012224 (Hall) discloses a wagering game, preferably a variant of blackjack, that is played by at least one player placing at least three separate wagers on a single round of the wagering game. A first of the three wagers is committed to a first hand wagering position, a second of the at least three wagers committed to a second hand wagering position, and the third wager initially is not committed to specifically either the first or second wagering position. From a first set of playing cards, the player receives a separate hand at each of the first hand wagering position and the second hand wagering position. The player commits the third wager to either the first hand wagering position or the second hand wagering position.

Another method to enhance blackjack disclosed in prior art utilizes more than two cards to be dealt to the player and/or dealer. U.S. Pat. No. 6,543,773 (Mims) discloses a card game in which, after bets are made by a player, three cards are dealt to the player by the dealer who also receives three cards. Thereafter the player selects two of the three dealt cards to play in the manner of a game of conventional blackjack and the dealer selects two of three cards for dealer play.

U.S. Pat. No. 5,636,842 (Cabot, et al.) teaches methods of playing card games wherein a dealer is initially provided with a number of cards exceeding the minimum number required to play a hand. According to various embodiments, the dealer discards the excess cards during the play of a card hand.

U.S. Pat. No. 5,407,209 (Prerost) relates to a modification to the well-known card game of blackjack or 21. A player is dealt first and second cards after placing an original bet, and then elects to stand or take an additional third card. If a third card is taken, the player is given the option of keeping the card, or replacing the card. If the third card is replaced, an additional wager is placed by the player, and a replacement to the third card is given. The player then elects to stand or take additional cards. After the player has taken all desired cards, the dealer's hand and player's hand are compared to determine a winner.

The addition of novel side bets is another method that has been used to enhance the excitement and increase the house edge in blackjack. Some inventions are based on the array of cards in the player's hand. These include U.S. Pat. Nos. 7,354,042 (Moshal), 7,309,066 (Donaldson), 7,267,343 (Schreiner), 7,261,297 (Bermudez), 7,222,854 (Sorge), 7,147,226 (Moshal), 7,108,264 (Byme, et al.), 7,066,466 (Stavinsky, et al.), 6,854,731 (Saucier), 6,543,773 (Mims), 6,481,717 (Richardelle), 6,345,824 (Selitzky), 5,288,077 (Jones), 5,979,897 (Grossman), 5,839,730 (Pike), 5,577,731 (Jones), 5,615,888 (Lofink), and 5,632,485 (Woodland, et al.). Other prior art disclose side bets that are based on a combination of cards from the player and dealer hands. These include U.S. Pat. No. 7,175,180 (Webb), U.S. Pat. No.7,066,465 (Daines), U.S. Pat. No. 6,902,167 (Webb), U.S. Pat. No. 6,863,274 (Webb), U.S. Pat. No. 6,845,981 (Ko), U.S. Pat. No. 6,523,831 (Webb), and U.S. Pat. No. 6,481,719 (Webb). Some prior art is based on the value of the player hand vs. the value of the dealer hand, as disclosed in U.S. Pat. Nos. 7,097,175 (Centrone), U.S. Pat. No. 7,080,839 (Shackleford), U.S. Pat. No. 6,481,718 (Koelling), U.S. Pat. No. 6,450,500 (Miller), U.S. Pat. No. 5,732,949 (Josephs), and United States Patent Application No. 20070176366.

U.S. Pat. No. 7,222,855 teaches a side bet that is based on the cards in the player's hand plus community cards. Other patents or applications offer a side bet based on the cards in either the player or the dealer hand. These include U.S. Pat. Nos. 7,144,011 (Asher, et al.), U.S. Pat. No. 6,808,173 (Snow) and U.S. Pat. No. 5,673,917 (Vancura). Still other prior art for blackjack side bets are based on the cards in the dealer's hand. These include U.S. Pat. Nos. 6,845,981 (Ko) that is based upon the dealer's hand exceeding the target value, the total number of cards in the dealer's hand or the sum value of the dealer's first two cards alone or in conjunction with the player's hand; 5,791,989 (Slinkman) that is based on the dealer's first two cards being a standing hand; 5,174,579 (Griffiths) that is based on a dealer blackjack or bust on three or more playing cards; and United States Patent Application No. 20040259619 (Cranford) wherein participating players are able to wager on the dealer having a non-breaking hand containing two, three, four, five, six, or seven cards or wherein the dealer has an even or odd count, or an all red or all black hand.

Manufacturers of casino products have also recently turned their attention to electronic table games. These games rely on a table that has at least individual player monitor screens and a computer processor. As in internet card play, the gameplay is accelerated, providing more decisions per hour, and thus more revenue for the casino. Another appealing aspect of electronic table gaming from the casino's point of view is that a live dealer may not be needed, reducing personnel costs. And even if a dealer is required, he may not need to be professionally trained, as the processor will handle any complex decisions, results or compensations. To date, however, the majority of offered electronic table games are simply electronic versions of traditional felt-top games. Although the number of hands per hour is increased, the gameplay does not take advantage of the possibilities provided by the computer processor. Examples of electronic casino table card play systems include at least Published U.S. Patent Applications Nos.

20050090304; 20060055114; 20060058083; 20060058085; 20060058088; 20060058090; 20060058091; 20060058092; 20060058093; 20060068498; 20060068864; 20060068865; 20060068866; 20060068867; 20060068868; 20060068869; 20060068870; 20060068871; 20060068879; and 20060068899 (PokerTek, Inc. applications); 20050164759; 20050164762; (Shuffle Master, Inc.); and 20060199629; 20060205472; 20070015561; 20070049368; 20070049369; 20070072663; 20070072664; 20070142107; and 20070281786 (Sines et al.).

It is an ever-increasing challenge to provide electronic card game players with new and enticing gameplay features that will stimulate player interest and increase time at the table or the machine. Despite the novel inventions as described in prior art, it would be advantageous to invent a blackjack game for electronic table gaming that takes advantage of processing abilities and relies on familiar game patterns, yet provides revolutionary decision-making choices while accelerating the pace of the game and increasing the house edge.

Each of the references discussed in this text art are incorporated herein in their entirety for all purposes including enablement of multiplayer platforms and structures for execution of games according to the present invention.

SUMMARY OF THE INVENTION

A method of playing an electronic wagering card game for a single player or multiple players uses at least a single deck of 52 standard playing cards having a standard rank or 52 cards plus one or more jokers, wild cards or specialty cards (e.g., bonus indicators, special feature indicators, additional card(s) indicator, etc.). The present invention requires two hands of blackjack that are played against a single house hand, wherein both of the two player hands must at least win, or alternately at least tie, the house hand in order to win the game. The game may begin with a first multiple part wager (referred to herein as a "total wager," e.g., a multiple part wager) from each player, the total wager comprising at least an Ante wager and at least one separate Play wager. The game may additionally allow one or more Side Bet wagers that may or may not be equal to the Ante or Play wager. The game is played with a predetermined number of initially-dealt cards (a partial hand) to each player and the dealer; preferably each player is randomly dealt four cards face up in an initial card area, and the dealer receives a first face up card and three face down cards. The initially-dealt player cards will be eventually displayed in two player hand areas, with each player hand randomly or alternately optimally receiving two of the initially-dealt cards. Prior to the initial cards being redisplayed in his two player hands, each player is given the option of either a) folding (losing his Ante wager and terminating his game) or b) accepting the initial array of cards and continue playing. For each player who has decided to continue playing, the initially-dealt cards are placed into the player's two hands as described above. Each player then plays out his hands one at a time according to the rules of traditional blackjack. Preferably doubling down is allowed, but splitting pairs or taking insurance are not allowed. Additional cards may be dealt to each player in a sequential fashion, as in traditional blackjack, or alternately all additional cards may be dealt as community cards. When all active players have finalized their hands, the dealer plays out his hand according to the traditional rules of blackjack. Each of the player's final hands is compared to the final dealer hand, and wins, loses and/or ties are determined as in traditional blackjack. If the player has lost at least one hand, he loses both his Ante and his Play bets. If the player has won both hands, or alternately at least tied both hands, he wins on the Ante bet and the Play bet. Preferably the Ante bet pays 1:1, and the Play bet is resolved according to a first predetermined paytable and is based on the make-up of each winning hand. For instance, a tie/tie result may be a push on the Play bet; a tie/win result may pay 1:1 on the Play bet; two wins may pay 2:1 on the Play bet; a blackjack/tie may pay 3:1 on the Play bet; a blackjack/win may pay 4:1 on the Play bet; and two blackjacks may pay 10:1 on the Play bet.

As previously disclosed, in addition to the Ante and Play bets, each player may initially be offered the option of making a Side Bet before the game begins. The Side Bet preferably is based on the make-up of the cards in the dealer's final hand. If the player has folded, the player may either lose his Side Bet wager, or alternately, keep his Side Bet wager. If the Side Bet is kept, it may or may not remain in play. If the player has busted in at least one hand, or if the dealer busts, the player may or may not lose his Side Bet wager, and that wager may or may not remain in play. If the dealer has a non-bust hand (whether it is a winning or losing hand), the cards in the final dealer hand are examined for predetermined poker-type card combinations, and the result is resolved according to a second predetermined paytable. Alternately, the non-bust dealer hand may be eligible for Side Bets pays only if the dealer hand is comprised of a predetermined number of cards (2 cards and/or 3 cards, for instance). All active (i.e., non-bust) players may be eligible to win their Side Bet if the final dealer hand is a non-bust hand, even if the player does not beat the dealer in the primary blackjack game.

BRIEF DESCRIPTION OF THE FIGURES

FIG. 10 shows a sample paytable for the main 2-hand blackjack game as taught in the present invention.

FIG. 11 shows a sample paytable for the side bet as taught in the present invention.

DETAILED DESCRIPTION OF THE INVENTION

Figure 1:
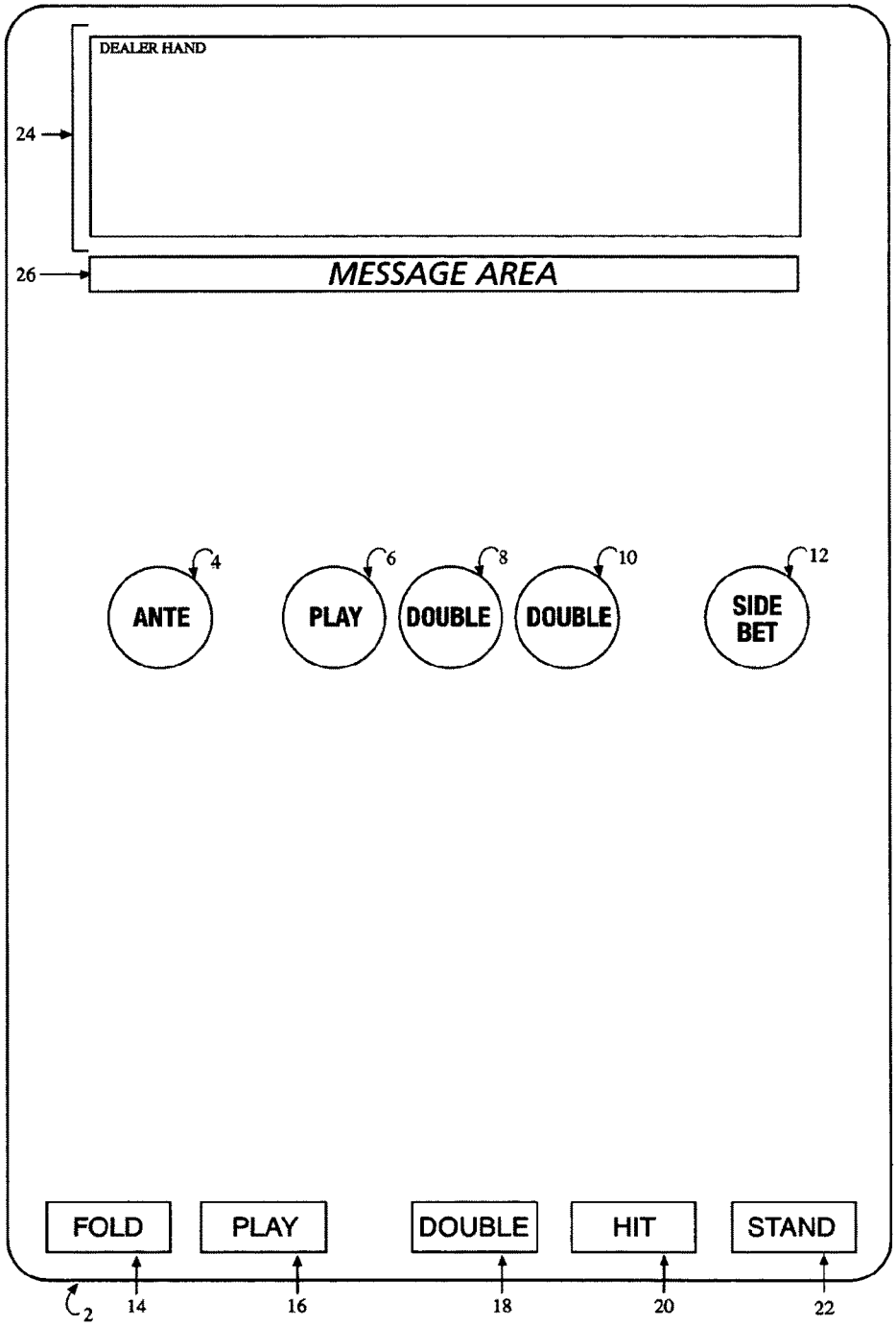
FIG. 1 shows a screen monitor with the elements of the game technology described herein.

A method of playing an electronic wagering card game or partially electronic wagering game (in which a processing system is provided with knowledge of at least playing card count for all hands dealt in a round of play) for a single player or multiple players using either player exclusive cards or community cards to complete hands is disclosed. The game preferably uses as the source of symbols one original deck of 52 standard playing cards having a standard rank and suit system, although wild cards, jokers and specialty cards may be used, and although optionally, multiple decks each of 52 cards may be used. Alternately, a deck or decks, each of more than 52 cards that may include jokers, wild cards or special cards may be used. The method may be played utilizing gameplay and strategies as are familiarly known in traditional blackjack games. The card game is generally based on the traditional gameplay of blackjack wherein the object of the game is to accumulate more points than the dealer without exceeding 21 points, except that the present invention requires two player hands of blackjack that are played against a single house hand, and wherein both of the two player hands must at least win, or alternately at least tie, the house hand in order to win the game.

A description of at least one embodiment of a method of playing a wagering playing card game according to the present technology includes:

a) at least one player making a first wager (with at least one part, and preferably at least two parts);

b) the at least one player receiving four playing cards, A, B, C and D as a starting set of playing cards;

c) the dealer receiving at least two playing cards (and preferably at least 3 or at least 4 cards, these cards being received in a "play order," an order in which the cards will be revealed during play of the game) as a dealer starting hand;

d) the at least one player reviewing all playing cards in the starting set of playing cards and electing to i) continue playing the wagering playing card game or ii) forfeit some or all of the first wager and terminating a round of play of the wagering playing card game;

e) if the at least one player elects i), the at least one player arranging (or in a completely electronic system, a processor randomly arranging or alternately optimally arranging) the starting set of playing cards into two two-card partial hands for blackjack, f) if the at least one player has elected i) and two two-card blackjack hands have been formed, playing both of the two-card blackjack hands to conclusion;

g) after the at least one player has played both of the two-card blackjack hands to conclusion, the dealer playing the dealer starting hand to conclusion as a blackjack hand; and h) resolving all wagers.

The resolving of all wagers is preferably done against a paytable in which a player may win odds greater than 2:1 for at least some winning events, such as two wins, two wins without the dealer busting, a blackjack and a win, two twenty-one counts, a twenty count and a twenty-one count in a player win (with or without a dealer busting), two blackjacks, etc. To win an award when resolving all wagers, a player usually must at least tie both hands or to win an award when resolving all wagers, a player must at least tie one hand and win another hand.

In a preferred embodiment, the at least one player is prohibited from splitting any partial hand formed from the starting set of playing cards. Another preferred feature is where the first wager comprises an at least two-part wager, and d) ii) is performed by forfeiting only one part of the at least two-part wager. In another preferred embodiment, the dealer's at least two cards comprise at least three cards received in a play order, and only one card is provided face-up. In this way, at least some of the dealer's hit cards are predetermined and fixed. It is also possible to limit dealer's hit cards by limiting the dealer to the specific number of cards dealt to the dealer (3, 4, 5 or 6, for example), offering a player another slight advantage.

An alternative description of technology herein comprises a method of playing a wagering playing card game in which at least:

a) at least one player making a first wager;

b) the at least one player receiving four playing cards, A, B, C and D as a starting set of playing cards;

c) the dealer receiving at least two playing cards as a dealer starting hand;

d) the at least one player reviewing all playing cards in the starting set of playing cards and electing to i) continue playing the wagering playing card game or ii) forfeit some or all of the first wager and terminating a round of play of the wagering playing card game;

e) in effecting step i), the starting set of playing cards is randomly distributed into two two-card partial hands for blackjack;

f) if the at least one player has elected i) and formed two two-card blackjack hands, playing both of the two-card blackjack hands to conclusion;

g) after the at least one player has played both of the two-card blackjack hands to conclusion, the dealer playing the dealer starter hand to conclusion as a blackjack hand; and h) resolving all wagers.

Preferably step d) is performed before step e). It is also possible to limit dealer's hit cards by limiting the dealer to the specific number of cards dealt to the dealer (3, 4, 5 or 6, for example), offering a player another slight advantage. The dealer's at least two cards may comprise at least three cards received in a play order, and only one card is provided face-up.

It is contemplated that the at least one player may be provided best strategy information on a display screen based on knowledge of count of the at least one player's starting set of playing cards or knowledge of count of the at least one player's starting set of playing cards and knowledge of a dealer's face-up card.

At least some playing cards received by the at least one player in playing a blackjack hand to conclusion may be received as common cards with any other players in the wagering playing card game. In these methods, a side bet may be placed by the at least one player before step d) and resolution of the side bet is preferably based at least in part on predetermined hands made from the final, non-busting dealer hand, although it is also contemplated that the resolution of the side bet may be based at least in part on predetermined hands made from starting set of playing cards, final hands resulting from the starting set of playing cards and/or event resolution against a final, non-busting dealer hand.

The present invention can be generally described sequentially in terms of a first total wager(s), an initial deal, a fold/play decision, a display of two player hands, a player hands-completion stage, a dealer hands-completion stage, and a resolution of the wager(s). These stages are individually described below in order to more fully provide understanding of the present invention.

The Wager

The game may begin with each player placing a total wager, the total wager comprising preferably at least an Ante Bet wager and preferably at least one separate and additional Play Bet wager made before cards are dealt. Alternately, a single Play wager only may be required. Since the final math has not been as yet analyzed, the present invention may comprise separate wagers including, but not requiring, an Ante Bet, a Play Bet and an optional Side Bet that is based on the make-up of the cards in the dealer's finalized, non-bust hand.

The structure of the wagers may be varied to enable the house to control the house percentage on the game, and the variation of the wager structure may be done in conjunction with varying payout amounts in a paytable. For example, the Ante wager may be a single minimum unit of wager (e.g., at least $1, at least $5, at least $10 or at least $25) and the Play wager may be a defined specific amount or range of amounts (e.g., 1×-2× the Ante, 1×-5× the Ante, exactly 2× the Ante, 2×-10× the Ante, etc.) proportional to the Ante amount. For example, the Play amount may be limited to an amount less than, less than and equal to, equal to, equal to or greater than the Ante, and the proportion of the differences may be fixed. For example, a Play wager less than the Ante may be required to be one-half the Ante wager or larger than or equal to wagers may be restricted to 1-10 times the Ante wager. The allowable size of the Play wager may be restricted based upon the time of the placement of the wager. For example, if a Play wager is or must be placed at the same time as the Ante wager (without viewing the player's cards and with or without an option to fold and withdraw the Ante wager), the Play wager may be restricted to less than or less than and equal to the Ante wager or less than, equal to and greater than the Ante wager, within fixed allowable ranges of multiples.

The Initial Deal

The game is played with a predetermined number of randomly, initially-dealt face up cards to each player as an initial hand. Preferably each player is dealt four face-up cards in an initial deal area in each player position, and the dealer receives a first face-up card and at least one, but preferably three, face-down cards. Preferably the deal is executed by each single player and the dealer receiving a first card, then a second card, then a third card and finally a fourth card to form an array or initial hand, although batches of four cards each may be dealt as a complete array. Each initially-dealt player card array will eventually be displayed in two separate and distinct player-hand areas, with each player hand randomly receiving two of the initially dealt cards. For example, if the initial array is comprised of Card A, Card B, Card C and Card D, the player's hands will consist of a) Card A and Card B in the first hand, plus Card C and Card D in the second hand; b) Card A and Card C in the first hand, plus Card B and Card D in the second hand; or c) Card A and Card D in the first hand, plus Card B and Card C in the second hand; d) Card B and Card C in the first hand, plus Card A and Card D in the second hand; e) Card B and Card D in the first hand, plus Card A and Card C in the second hand; or f) Card C and Card D in the first hand, plus Card A and Card B in the second hand.

The Fold/Play Decision

After examining the initially-dealt cards, and before the initial cards are redisplayed or rearranged or reoriented as two initial partial player hands, each player is then given the option of either a) folding (losing at least the Ante wager or the second part of the total wager or both parts of the total wager and terminating the game) or b) accepting the initial array of cards and continuing play. If the game is played with an Ante wager, the player may fold by losing his Ante wager. Alternately, the player may fold by losing his Play wager. If the game is played without an Ante wager, the player may fold by losing at least a portion of his Play wager. If the player folds, he may or may not lose his Side Bet wager; a remaining Side Bet wager may or may not remain in play.

The Redistribution of the Initial Deal Cards

For each player who has decided to continue playing, the initially-dealt cards are randomly placed into the player's two two-card hands as described in THE INITIAL DEAL above. In an separate method, the player may choose to specifically place, or alternately the processor may optimally place, the initially-dealt cards into the two two-card player hands.

The Completion of the Player Hands

Each player plays out his hands one at a time according to the rules of traditional blackjack. Preferably doubling down is allowed, but splitting pairs or taking insurance are preferably not allowed (in both or one hand). Each player is allowed to double down (place an additional bet equal to and adding to the Play bet) on either or both of the initial two-card partial hands to receive exactly just one additional card per hand, hit (receive an additional card), or stand (receive no more cards). Additional cards may be dealt to the players in one of the following manners: a) one card at a time as in traditional blackjack to first player's first hand until the player busts or stands, to the first player's second hand until the player busts or stands and in like manner to the at least second player if there are more than one players, or b) as community cards. If the additional cards are dealt in communal fashion, all active players may be required to "lock in" their double/hit/or stand decision simultaneously or nearly simultaneously until a decision has been made by all players. One additional same card is then provided to all players who doubled or hit. Each additional card is provided in like manner until all players have either busted or stood. At any time that a players busts, preferably both of his hands are eliminated along with both his Ante and Play wagers, and any Side Bet wager may or may not remain in play.

The Completion of the Dealer Hand

When all active players have finalized their hands, the dealer plays out his hand according to the traditional rules of blackjack. The dealer "flips over" the first face down card, and consecutively the third and fourth face down cards (and additional cards if needed) until his total exceeds 21 (busts) or until he reaches a total of 17 or more. A dealer "soft 17" (an Ace and 6) may require an additional dealer hit according to the rules dictated by an individual casino. Each of the player's final hands is then compared to the final dealer hand, and wins, loses and/or ties are determined as in traditional blackjack. If the player has lost at least one hand, preferably he loses both his Ante and his Play bets. If the player has won both hands, or alternately at least tied both hands, he wins on the Ante bet and the Play bet. Preferably the Ante bet pays 1:1, and the Play bet is resolved according to a first predetermined paytable and is based on the make-up of each winning player hand. For instance, a tie/tie result may be a push on the Play bet; a tie/win result may pay 1:1 on the Play bet; two wins may pay 2:1 on the Play bet; a blackjack/tie may pay 3:1 on the Play bet; a blackjack/win may pay 4:1 on the Play bet; and two blackjacks may pay 10:1 on the Play bet. The main paytable is constructed so that there is a reasonable statistical advantage to the house in the play of the game. It must be again noted that the paytables are preferably restricted to payment on events wherein both of the player's hands meet a minimum criterion (i.e., at least a tie or at least a win).

The Side Bet

As disclosed previously, in addition to the Ante and Play bets, each player may initially be offered the option of making a Side Bet before the game begins. The Side Bet is preferably based on the array of cards in the dealer's final hand. If the player has folded, his Side Bet wager may or may not be lost; if the Side Bet wager is not lost, in may or may not remain in play. If the player has busted in at least one hand, his Side Bet wager may or may not be lost; if the Side Bet wager is not lost, in may or may not remain in play. If the dealer busts, the player preferably may lose his Side Bet wager. If the dealer has a non-bust hand (whether it is a winning or losing hand), the cards in the final dealer hand are examined for predetermined poker-type card combinations, and the result is resolved according to a second predetermined paytable. Alternately, the non-bust dealer hand may be eligible for Side Bets pays only if the dealer hand is comprised of a predetermined number of cards (2 cards and/or 3 cards, for instance). All active (i.e., non-bust) players may be eligible to win their Side Bet if the final dealer hand is a non-bust hand, even if the player does not beat the dealer in the primary blackjack game. The Side Bet paytable is constructed so that there is a reasonable statistical advantage to the house in the play of the game. It should be noted that side bet paytables are preferably restricted to payment on predetermined events occurring in the dealer's final non-bust hand, and are preferably based on poker-type hand rankings.

The various components of the electronic table or gaming machine are controlled by a central processing unit (CPU), also referred to herein as a controller or processor (such as a microcontroller or microprocessor). To provide gaming functions, the controller executes one or more game programs stored in a computer readable storage medium, in the form of memory. The controller performs the random selection using a random number generator (RNG) of an outcome from the plurality of possible outcomes of the wagering game. Alternatively, the random event may be determined at a remote controller. The remote controller may either use an RNG or a pooling scheme for its central determination of a game outcome. It should be noted that the controller may include one or more microprocessors, including, but not limited to, a master processor, a slave processor, and a secondary or parallel processor.

The controller is also coupled to the system memory and a money/credit detector. The system memory may comprise a volatile memory (e.g., a random-access memory [RAM]) and a non-volatile memory (e.g., an EPROM). The system memory may include multiple RAM and multiple program memories. The money/credit detector signals the processor that money and/or credits were input via the value input device. Preferably, these components are located within the housing of the gaming machine. However, as explained above, these components may be located outboard of the housing and connected to the remainder of the components of the gaming machine via a variety of different wired or wireless connection methods.

The controller is also connected to, and controls, the primary display, the player input device, and a payoff mechanism. The payoff mechanism is operable, in response to instructions from the controller, and awards a payoff to the player in response to certain winning outcomes that might occur in the basic game or the bonus game(s). The payoff may be provided in the form of points, bills, tickets, coupons, cards, etc. For example, the payoff mechanism may include both a ticket printer and a coin outlet. However, any of a variety of payoff mechanisms well known in the art may be implemented, including cards, coins, tickets, smartcards, cash, etc. One or more pay tables stored in the system memory determine the payoff amounts distributed by the payoff mechanism.

Communications between the controller and both the peripheral components of the gaming machine and external systems occur through input/output (I/O) circuits. More specifically, the controller directs and receives inputs from the peripheral components of the gaming machine through the input/output circuits. Further, the controller communicates with the external systems via the I/O circuits and a communication path (e.g., serial, parallel, IR, RC, 10bT, etc.). The external systems may include a gaming network, other gaming machines, a gaming server, communications hardware, or a variety of other interfaced systems or components. Even though the I/O circuits may be shown as a single block, it should be noted that each of the I/O circuits may include different types of I/O circuits.

Controller, as used herein, comprises any combination of hardware, software, and/or firmware that may be disposed or reside inside and/or outside the gaming machine that may communicate with and/or control the transfer of data between the gaming machine and a bus, another computer, processor, or device and/or a service and/or a network. The controller may comprise one or more controllers or processors. The controller may, alternatively, comprise a CPU in combination with other components, such as the I/O circuits and the system memory.

In a preferred embodiment of the present invention, a blackjack-type game is played on an electronic gaming table. The object of the game is to win (or at least tie) both of two player hands against one dealer hand. Individual player monitor screens are provided, and preferably a dealer monitor screen is also provided. Alternatively, a common player large screen panel can be provided with individual player areas and community card areas, or a separate screen or monitor provided for the community cards as shown in Published US Patent Applications 20050164759 and 20050164762. Each player monitor screen preferably comprises at least an initial player card area, a card area comprising a first hand for the player and a second hand for the player, a card area for the dealer's hand, betting circle areas, and player input buttons including at least Fold, Play, Double, Hit and Stand. The game preferably is played with one virtual deck of 52 standard playing cards, although multiple decks may be just as preferably used. Each player must make two equal bets to begin the game: an Ante wager, and a Play wager. An optional Side Bet wager may also be placed, and may or may not be equal to the Ante or Play wagers. Four different cards are dealt to each player, being placed face-up into an initial card area on his player monitor screen, and four cards (one face-up and three face-down) are dealt to the dealer (shown either in a section on the player monitor screen, a separate dealer monitor, or both). By dealing more down cards for the dealer than are usually provided in traditional blackjack play, there may be less or none of the hostility or blame that sometimes arises between players when one player believes another player's decision has influenced the dealer's hand in an adverse way for the players.

Each initially-dealt player card array will eventually be displayed in two player-hand areas on his monitor screen, with each player hand randomly receiving two of the initially dealt cards. For example, if the initial array is comprised of Card A, Card B, Card C and Card D, the player's hands will consist of a) Card A and Card B in the first hand, plus Card C and Card D in the second hand; b) Card A and Card C in the first hand, plus Card B and Card D in the second hand; or c) Card A and Card D in the first hand, plus Card B and Card C in the second hand; d) Card B and Card C in the first hand, plus Card A and Card D in the second hand; e) Card B and Card D in the first hand, plus Card A and Card C in the second hand; or f) Card C and Card D in the first hand, plus Card A and Card B in the second hand. After examining his four cards against the dealer's up card, each player may decide to either Fold (losing the Ante wager), or Play. If the player Folds, preferably any Side Bet that he has wagered remains in play. If the player decides to Play, his four initial cards are immediately or almost immediately randomly displayed in his two hands as previously described. Although any additional cards may be dealt as in traditional blackjack (one card at a time to first player's first hand until the player busts or stands, to the first player's second hand until the player busts or stands and in like manner to the at least second player if there are more than one players), it is preferred that all additional cards are community cards. Dealing additional cards as community cards provides a unique gameplay that makes the game quicker, and eliminates disparity among players who may believe that a previous player's decision(s) adversely affected their play. Before the initial community card is dealt, each active player indicates whether or not he chooses to double (if applicable), hit or stand. When all players have "locked in" their choice (either verbally, with hand signals, or preferably by pressing an indication button on the table or their monitor screen), a first same community card is added to each player's first blackjack hand if the player has doubled or hit. If the player has indicated to stand, that first card is not dealt to his hand, and his first hand is finalized. All players then lock in their choice for a second community card. It should be appreciated that one same community card may be displayed in the first hand of one player, and in the second hand of another player. For example, assuming the dealer has a 5 for his up card, and if Player A stands on his first hand of Queen-10, and therefore does not receive the first community card being a 7, his next decision will concern his second hand. If Player B hits on his first hand of 3-4, he receives the same 7, and his second decision will still concern his first hand, since he has not busted or stood. To further the example, if Player A has 4-7 in his second hand and chooses to double, the next community card being a 6 is added to his second hand, and that hand is now finalized. At the same time, Player B receives the 6 into his first hand. A third decision is then made by all active players to again either double (if applicable), hit or stand. Again to further the example, Player A already has two finalized hands, and does not participate in any more decisions. Player B has 3-4-7-6 (20 total) and decides to stand. He then makes a fourth decision to play his second hand. Play continues in this same fashion until all active players have finalized both of their hands. Any player who has busted on at least one hand is preferably out of the game, with all of his cards, Ante wager and Play wager being eliminated. Preferably, if the player has wagered a Side Bet, that wager remains in play even if the player has busted. The dealer then plays out his hand by first revealing his first down card, and sequentially the third and the four down cards, or more, if needed. If the dealer's total exceeds 21 points, he busts, and all active players win according to a predetermined paytable. If the dealer receives a total of 17 or more (depending on a particular house's rules), he stands, and his total is compared to each of each player's two hands. Wins are based on the makeup of the player's first hand vs. the dealer hand plus the makeup of his second hand against the dealer hand, and are paid according to a first predetermined paytable. The Side Bet is then resolved by examining only the array of cards in the dealer's hand. If the dealer has busted, the Side Bet is forfeited. If the dealer has an active final hand, the array of cards are analyzed for poker-type card combinations (i.e., Pair, 3-of-a-Kind, 4-of-a-Kind, Straight, Flush, Straight Flush), and wins are paid according to a second predetermined paytable.

Reference to the Figures will assist in further understanding of the practice of the present invention.

FIG. 1 shows a single player monitor screen layout 2 with elements for a 2-hand blackjack game to be played on an electronic device. Shown on the monitor screen 2 are five betting circle areas consisting of an Ante Bet 4, a Play Bet 6, a first Double Bet 8, a second Double Bet 10, and a Side Bet 12. Five player buttons (physical or virtual) are also shown, including Fold 14, Play 16, Double 18, Hit 20 and Stand 22. An area for the dealer's hand 24 is shown, as well as a message area 26.

Figure 2:
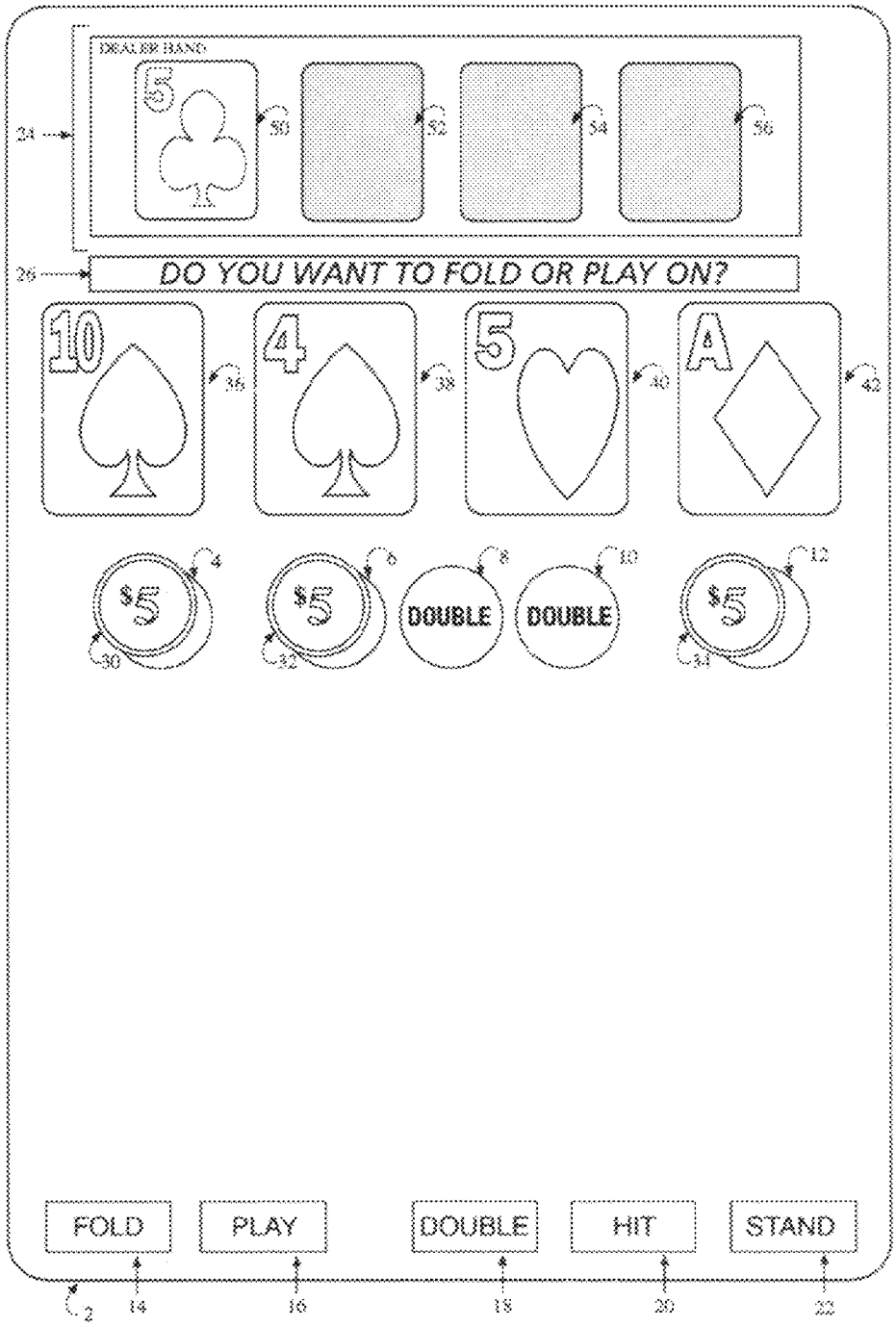
FIG. 2 shows a first game utilizing the game technology described herein.

FIG. 2 refers to the elements in FIG. 1 and shows the wagering and initial deal for a first game. Here the player has made the required two equal bets to play the game, as illustrated by one $5 chip 30 being placed on the Ante betting circle 4 and by one $5 chip 32 being placed on the Play betting circle 6. The player has also made a Side Bet by placing one $5 chip 34 being placed on the Side Bet betting circle 12. Four different cards from one virtual single traditional deck of 52 cards are then randomly dealt to each player who has wagered to play the game. The single-player monitor screen shows the four initially-dealt player cards being shown face up (36, 38, 40, 42) on the monitor screen 2, and four dealer cards (the first card face up 50, and three face-down cards [52, 54, 56]) in the dealer card area 24.

Figure 3:
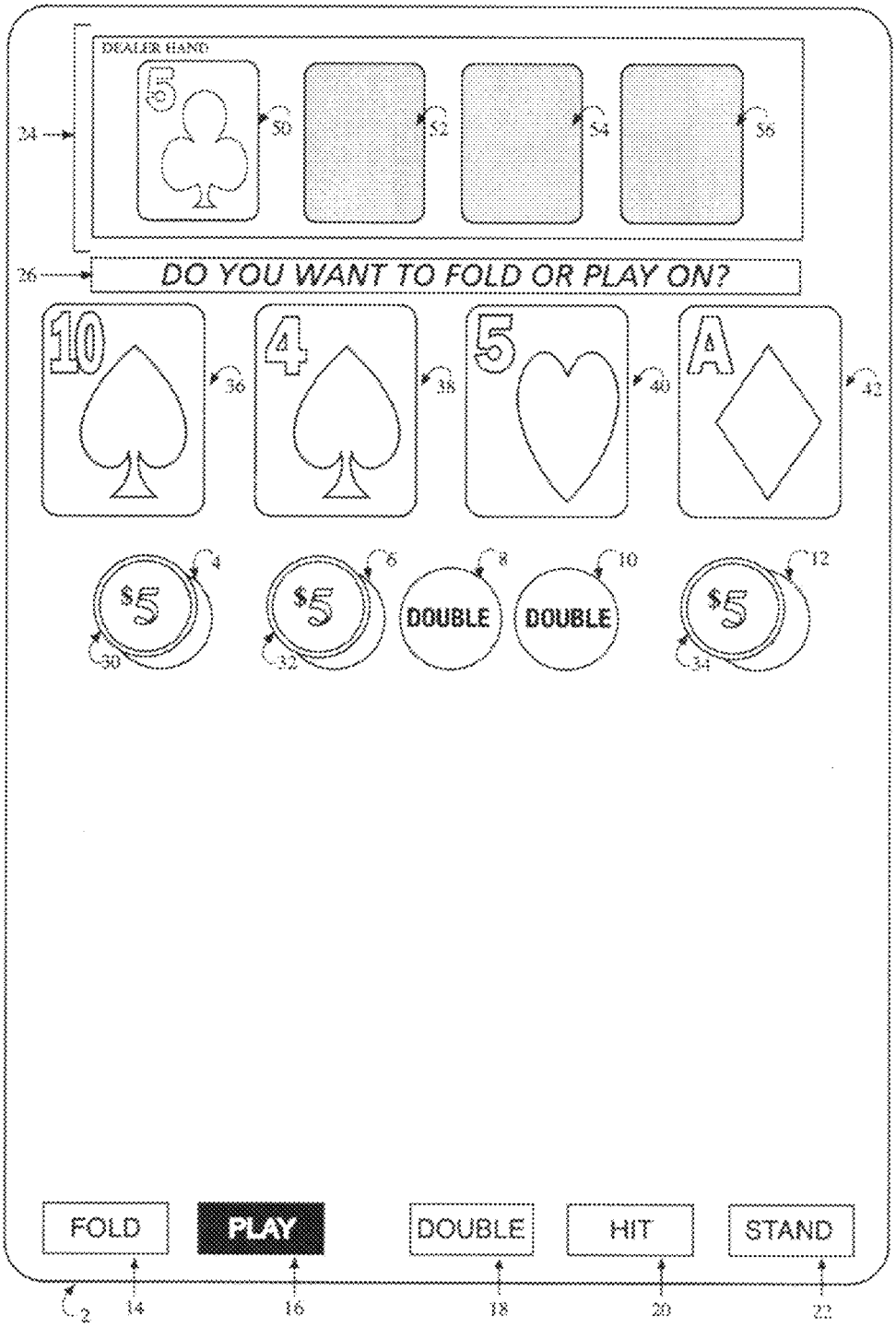
FIG. 3 shows the first game at a later stage.

FIG. 3 refers to the elements in FIG. 2, and shows the message box 26 instructing the player of his choice to either fold (losing his Ante Bet) or play on. Here the player decides to continue with the game instead of folding. Since his cards look potentially lucrative against the dealer's up card 50, with a good potential for an eventual win, the player presses the Play button 16.

Figure 4:
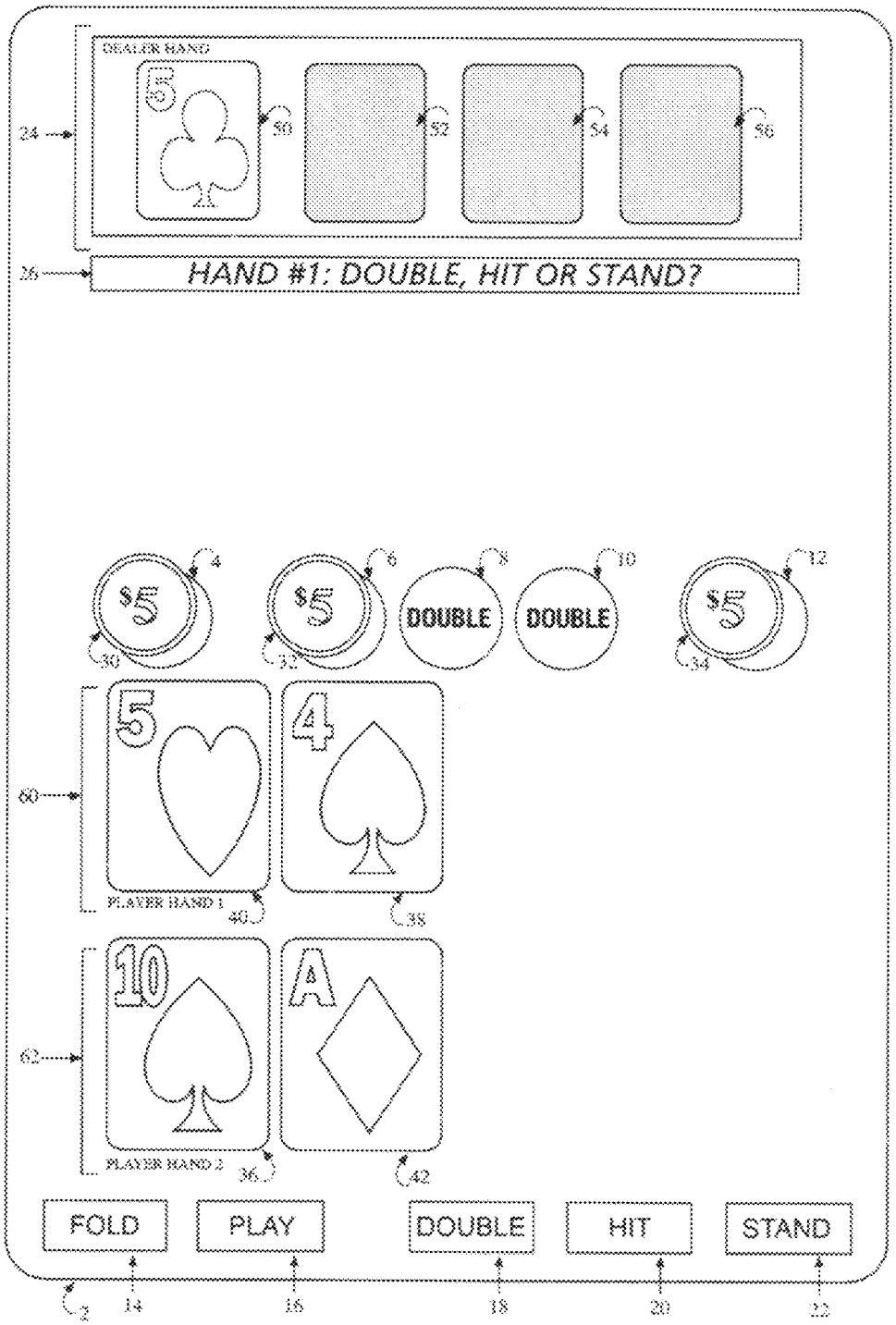
FIG. 4 shows the first game at a later stage.

FIG. 4 refers to the elements in FIG. 3. The player's initially-dealt cards (36, 38, 40, 42) are randomly redisplayed into the two player hand areas (60, 62). The player's first hand is comprised of the Five of Hearts 40 and the Four of Spades 38, for a total of 9 points. The player's second hand is comprised of the Ten of Spades 36 and the Ace of Diamonds 42, for a total of 21 points. Each player is then asked via the message box 26 whether he would like to Double. Hit or Stand on Hand #1 60.

Figure 5:
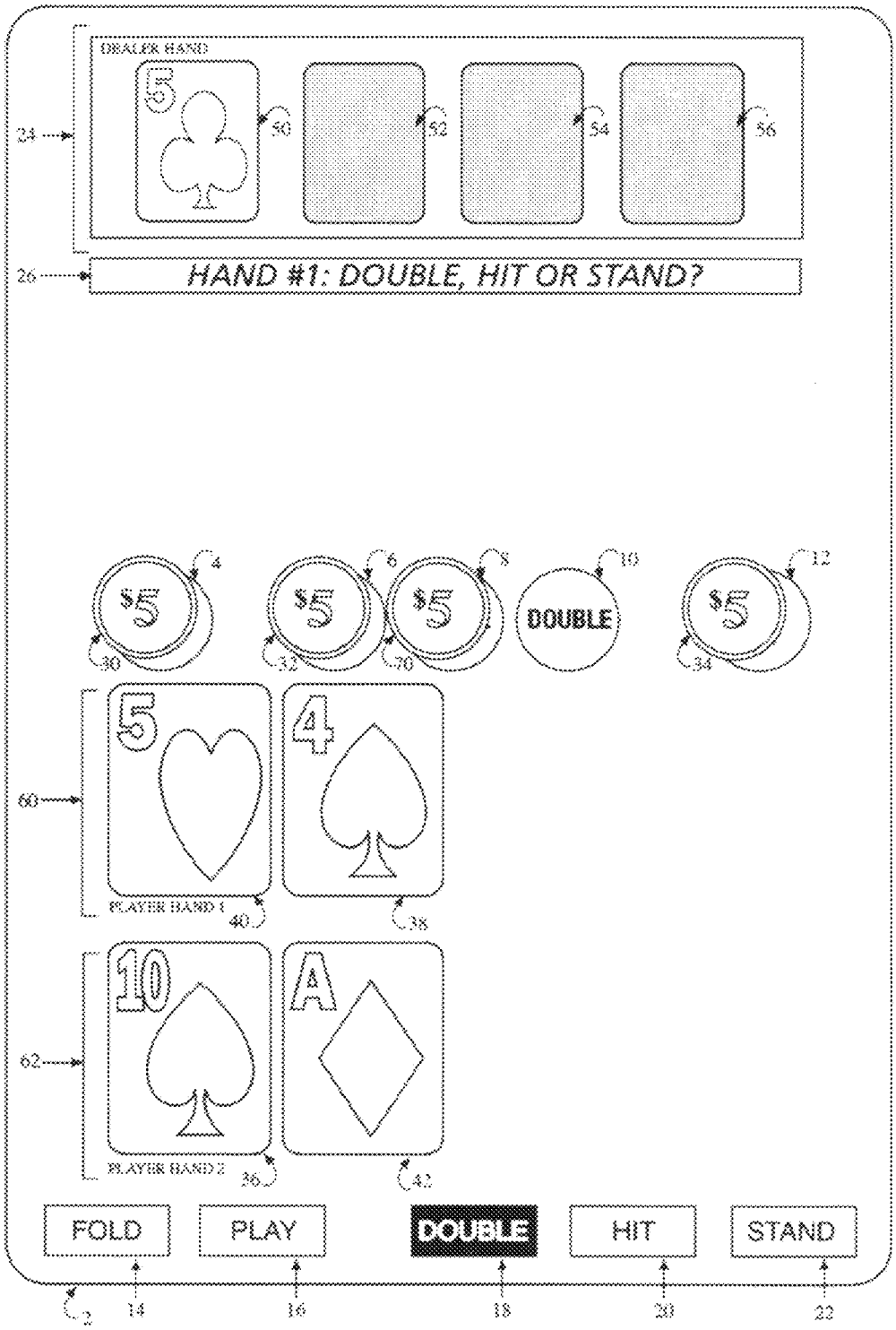
FIG. 5 shows the first game at a later stage.

FIG. 5 refers to the elements in FIG. 4 after the player has locked in his choice to Double Down 18 on Hand #1 60, and an additional $5 wager 70 is placed on the first Double betting circle 8.

Figure 6:
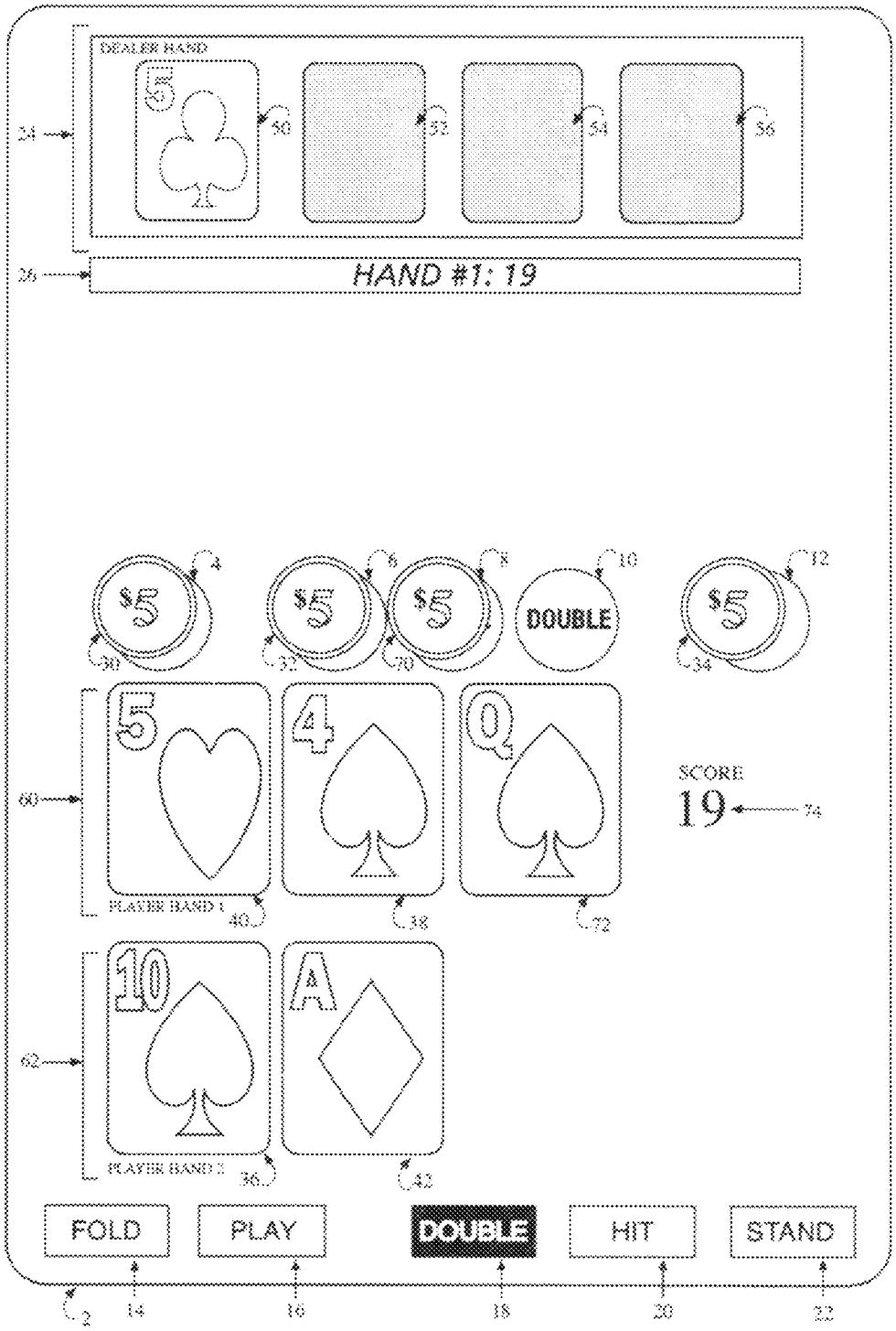
FIG. 6 shows the first game at a later stage.

FIG. 6 refers to the elements in FIG. 5. Since the player has chosen to double down, and according to traditional blackjack rules, he is dealt specifically only one card to his first hand. After this card, the Queen of Spades 72, is dealt, the player's first hand is finalized with a score of 19 points 74 that is also indicated in the message box 26. Play immediately goes to the player's second hand 62.

Figure 7:
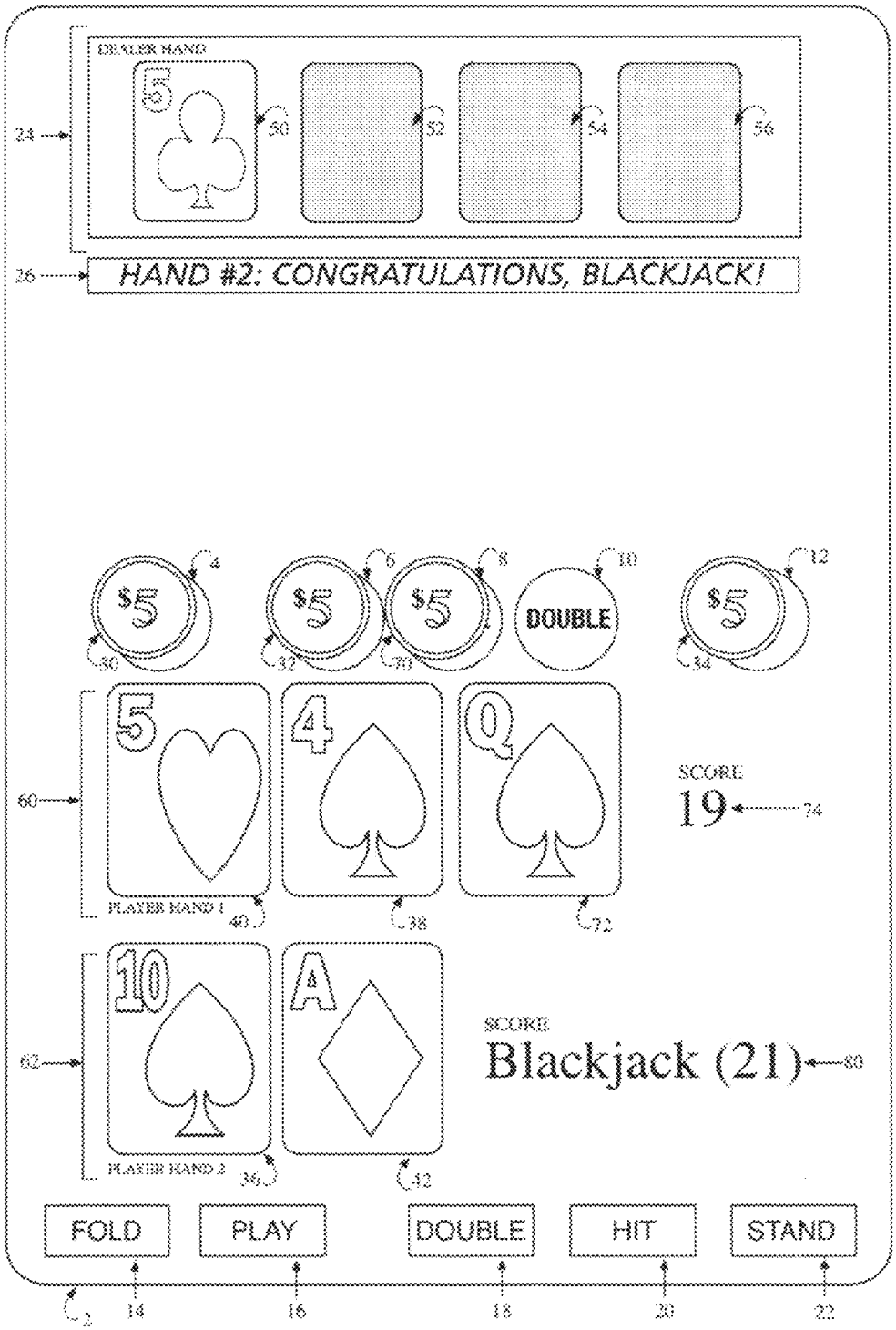
FIG. 7 shows the first game at a later stage.

FIG. 7 refers to the elements in FIG. 6, with the player being informed via the message box 26 of a win for getting a blackjack 80 on his second hand. Since a blackjack is automatic, he does not have to decide whether to Double, Hit or Stand on the second hand, and both of his game hands are finalized.

Figure 8:
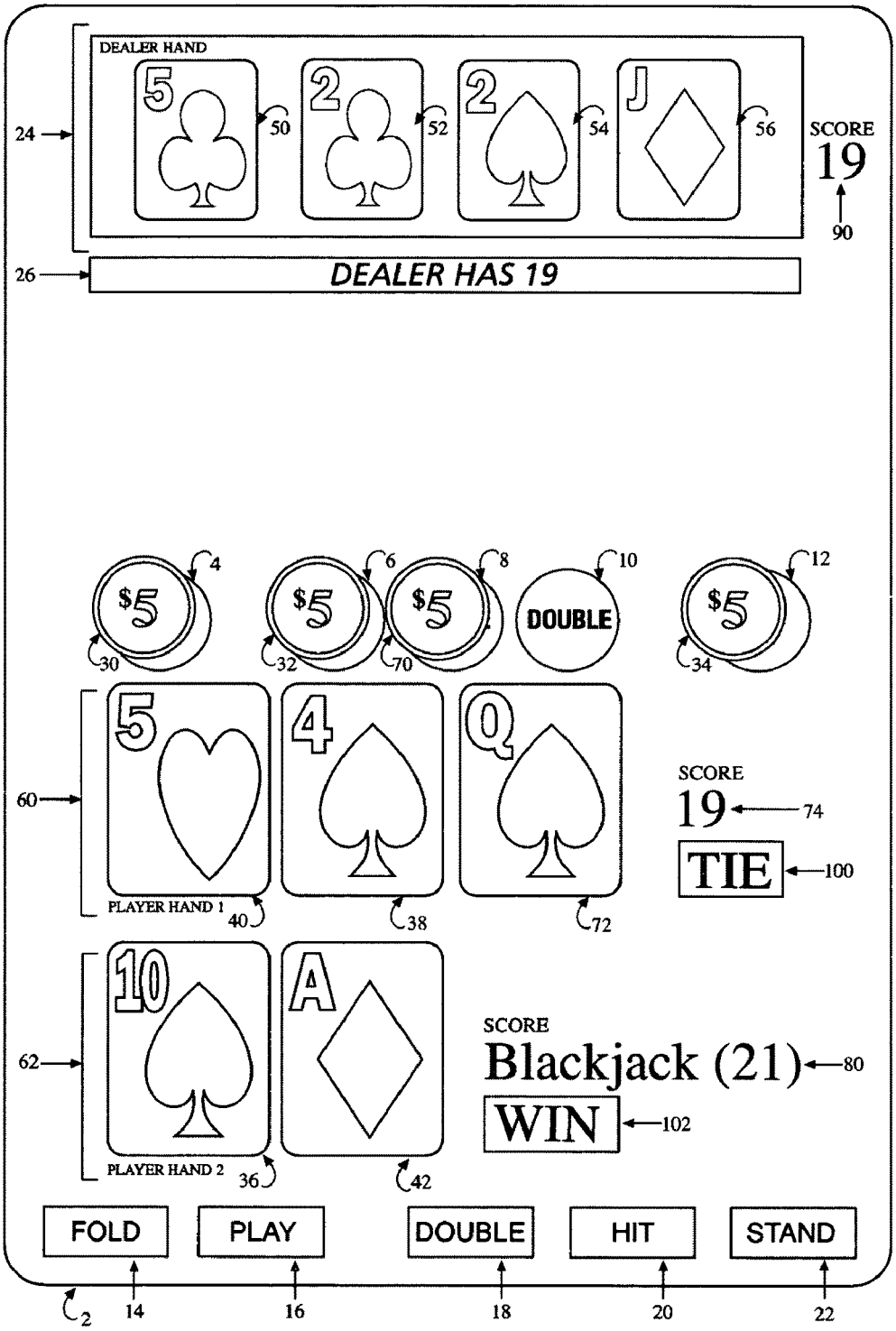
FIG. 8 shows the first game at a later stage.

FIG. 8 refers to the elements in FIG. 7 after the player hands have been finalized. The dealer hand is then finalized by sequentially turning over cards until the dealer busts or stands with at least a total of 17 points. Here the dealer obtains a hand the Five of Clubs 50, the Two of Clubs 52, the Two of Spades 54 and the Jack of Diamonds 56, for a total of 19 points 90. His hand total is displayed to the player via the message box 26, and is then compared individually to both of the player hands, with the result being a Tie 100 for the player on Hand #1 and a Blackjack 102 for the player on Hand #2.

Figure 9:
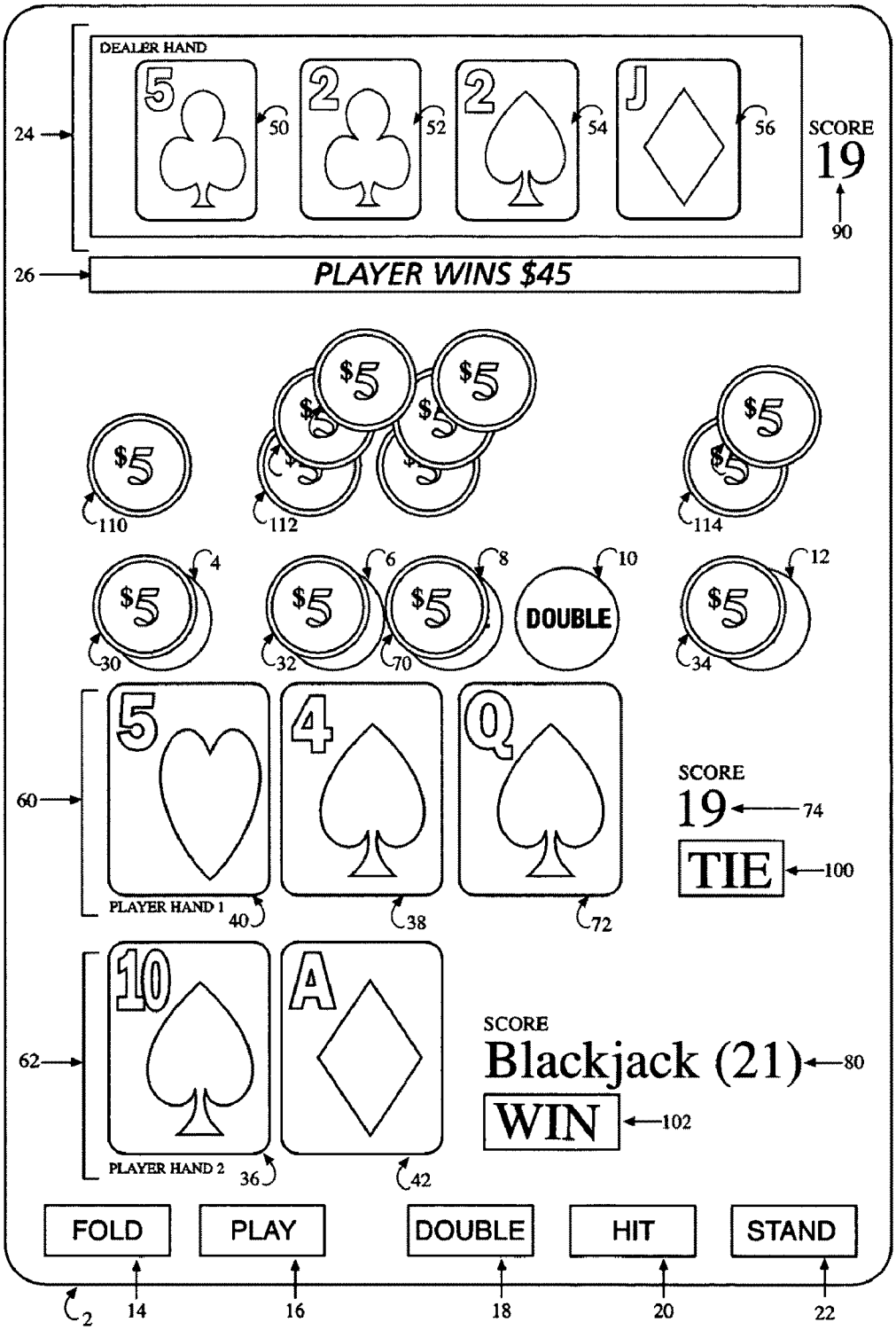
FIG. 9 shows the first game at a final stage.

FIG. 9 refers to the elements in FIG. 8 with the player winning $5 (1:1) 110 on his Ante Bet, $30 (3:1) 112 on his total Play Bet for the Tie/Blackjack win, and $10 (2:1) on his Side Bet for the win of a Pair, according to the sample paytables shown in FIG. 10 and FIG. 11. The total win of $45 is displayed in the message box 26.

FIG. 10 illustrates a sample paytable 120 for the main 2-hand blackjack game.

FIG. 11 illustrates a sample paytable 130 for the Side Bet.

It is also possible to speed up the play of an electronic game (or provide equivalent speed-enhancing information to a player using physical playing cards) by providing assistance on maximizing potential for a win in the distribution of the player cards, either in an absolute sense or with respect to the single disclosed dealer card. A look-up table can be established based on known probabilities for blackjack that provides the player with information on an optimum redistribution or ordering of the original four cards into two hands that provides the maximum potential for a result that is a win for the player. The player may either elect to follow information from the table or make an independent decision on folding or arrangement of the four cards.

The system for providing this information can be most easily included in a completely electronic system (with no physical cards and no physical chips), but can be included in any system where a display is provided to the individual players, such as systems where physical playing cards are used, the cards are read by electronic systems, the read information is transmitted and used within the system, and a players can make electronic wagers, as in the iTable™ gaming system developed by Shuffle Master, Inc. As the playing card information and hand count information is known to the system, and as there are individual player screens, information on optimum strategies can be provided to individual players on their individual screens.

In determining the optimum arrangement strategies and play strategies for individual players, a look-up table may be constructed in advance of play. The probabilities of winning outcomes can be based on a table considering only playing cards A, B, C and D, or by considering playing cards A, B, C and D and the dealer's up-card. A player may elect or decline to use this type of information providing function, may receive the function free or pay a fee for it, and may decline to use any provided strategies.

Although specific examples and specific paytables have been provided in this discussion, these specifics are intended to be only support for the generic concepts of the invention and are not intended to be absolute limits in the scope of the technology discussed.

What is claimed:

1. A method of playing a wagering playing card game on electronic gaming apparatus comprising a processor, value input device and display monitors associated with the value input device, the method comprising:

a) the processor recognizing at least a first wager at a value input device on each of two wagering position hands;

b) the processor providing information displayed on the display monitor associated with the value input terminal of the first wager, and four playing cards, A, B, C and D as a starting set of virtual playing cards displayed faced-up on the display monitor;

c) the processor providing information displayed as at least four playing cards as a dealer starting hand;

d) the processor recognizing instructions from the value input device with respect to an exercised option elections action between i) continuing to play the wagering playing card game at a wagering position having the value input device or ii) forfeiting some or all of the first wager and terminate a round of play of the wagering playing card game at the wagering position;

e) in effecting step d)-i), the starting set of virtual playing cards is randomly distributed by the processor into two two-card partial hands of virtual playing cards for blackjack;

f) if the processor has received instructions electing step d), selection i) and formed two two-card blackjack hands, the processor executes programs to complete steps playing both of the two-card blackjack hands to conclusion;

g) after the processor has executed programs to complete steps playing both of the two-card blackjack hands to conclusion, the processor executes programs to complete steps playing the dealer starter hand to conclusion as a blackjack dealer hand; and h) the processor resolving all wagers on each of the wager position hands.

2. The method of claim 1 wherein resolving all wagers resolved by the processor is done against a paytable in which wagers placed may win odds greater than 2:1 for at least some winning events.

3. The method of claim 1 wherein to win an award when the processor is resolving all wagers, the virtual blackjack dealer hand must at most tie both hands at a wagering position.

4. The method of claim 1 wherein to win an award when resolving all wagers, a wagering position must at least tie one hand and win another hand with respect to the blackjack dealer hand.

5. The method of claim 2 wherein the processor prohibits any wagering position from splitting any partial hand formed from the starting set of playing cards.

6. The method of claim 3 wherein the processor prohibits any wagering position from splitting any partial hand formed from the starting set of playing cards.

7. The method of claim 4 wherein the processor prohibits any wagering position from splitting any partial hand formed from the starting set of playing cards.

8. The method of claim 1 wherein the first wager comprises an at least two-part wager, and d) ii) is performed by the processor by forfeiting only one part of the at least two-part wager.

9. The method of claim 6 wherein the first wager comprises an at least two-part wager, and d) ii) is performed by the processor by forfeiting only one part of the at least two-part wager.

10. The method of claim 7 wherein the first wager comprises an at least two-part wager, and d) ii) is performed by the processor by forfeiting only one part of the at least two-part wager.

11. A method of playing a wagering playing card game on electronic gaming apparatus comprising a processor, value input device and display monitors associated with the value input device, the method comprising:

a) the processor recognizing at least a first wager at a value input device on two wager position hands;

b) the processor providing information displayed on the display monitor associated with the value input terminal of the first wager, and four playing cards, A, B, C and D as a starting set of virtual playing cards displayed face-up on the display monitor;

c) the processor providing information displayed as at least four virtual playing cards as a dealer starting hand;

d) the processor recognizing instructions from the value input device with respect to an election between i) continuing to play the wagering playing card game at a wagering position having the value input device or ii) forfeiting some or all of the first wager and terminate a round of play of the wagering playing card game at the wagering position;

e) in the processor effecting step d)-i), the starting set of virtual playing cards is randomly distributed by the processor into two two-card partial hands for blackjack;

f) if the processor has recognized an election of step d), selection i) and formed two-two-card blackjack hands, the processor plays both of the two-card blackjack hands to conclusion; g) after the at least one player has played both of the two-card blackjack hands to conclusion, the processor playing the dealer starter hand to conclusion as a blackjack hand; and h) the processor resolving all wagers.

12. The method of claim 11 wherein step d) is performed by the processor before step c).

13. The method of claim 1 wherein the processor provides information that is displayed on the display monitor that represents best strategy information based on knowledge by the processor of count of the at least one wagering position starting set of playing cards.

14. The method of claim 1 wherein the processor provides information that is displayed on the display monitor that represents best strategy information based on knowledge by the processor of count of the at least one wagering position starting set of playing cards and knowledge of a dealer's face-up card.

15. The method of claim 11 wherein at least some virtual playing cards provided by the processor to wagering positions in playing a blackjack hand to conclusion are received provided by the processor and displayed on the display monitor as common cards used at all wagering positions in the wagering playing card game.

16. The method of claim 12 wherein at least some virtual playing cards provided by the processor to wagering positions in playing a blackjack hand to conclusion are received provided by the processor and displayed on the display monitor as common cards used at all wagering positions in the wagering playing card game.

17. The method of claim 1 wherein a side bet is received by the processor from a wagering position before step d) and resolution by the processor of the side bet is based at least in part on predetermined hands made from a final, non-busting dealer hand.

18. The method of claim 1 wherein a side bet is received by the processor from a wagering position before step d) and resolution of the side bet by the processor is based at least in part on predetermined hands made from the starting set of playing cards, final hands resulting from the starting set of playing cards and/or event resolution against a final, non-busting dealer hand.

* * * * *